United States Patent [19]

Parks

[11] Patent Number: 4,644,364

[45] Date of Patent: Feb. 17, 1987

[54] METHOD OF AND MEANS FOR COUPLING A TWO CONDUCTOR TRANSMISSION LINE TO AN ANTENNA

[76] Inventor: Malcolm G. Parks, 224 Poplar Ave., San Bruno, Calif. 94066

[21] Appl. No.: 679,442

[22] Filed: Dec. 7, 1984

[51] Int. Cl.[4] ..... H01Q 9/04

[52] U.S. Cl. ..... 343/825; 343/861; 343/864

[58] Field of Search ..... 343/850, 852, 890, 856, 343/861, 862, 825, 831, 880–883, 864, 900

[56] References Cited

U.S. PATENT DOCUMENTS

| | | | |
|---|---|---|---|
| 1,831,921 | 11/1931 | Martin | 343/856 |
| 2,124,424 | 7/1938 | Leeds | 343/825 |
| 2,166,237 | 7/1939 | Cushman et al. | 343/850 |
| 4,259,673 | 3/1981 | Guretzky | 343/825 |

OTHER PUBLICATIONS

Thurnburg, "Multiband J Antenna", *Ham Radio,* Jul. 1978, pp. 74–76.

The ARRL Antenna Book, published by the American Radio Relay League, Newington, Conn., 14th Edition, 1983, pp. 11–24.

*Primary Examiner*—Eli Lieberman
*Assistant Examiner*—Michael C. Wimer
*Attorney, Agent, or Firm*—Thomas M. Freiburger

[57] ABSTRACT

Impedance matching between two conductor transmission lines and conventional antenna designs including a straight antenna element having an effective length of at least one-quarter wavelength in the operating frequency range and a zero impedance at one end is disclosed in which a straight coupling conductor having a length of about one-quarter wavelength in the operating frequency range is mounted in close spaced co-planar relation to such antenna element with one end electrically connected to the zero impedance end of the antenna element. The two conductors of the transmission line are coupled to the antenna element and coupling conductor, respectively, at the interconnected ends thereof and the spacing between the antenna element and the coupling conductor is adjusted along their coextensive lengths to achieve an impedance match at each frequency in the operating frequency range.

12 Claims, 7 Drawing Figures

METHOD OF AND MEANS FOR COUPLING A TWO CONDUCTOR TRANSMISSION LINE TO AN ANTENNA

FIELD OF THE INVENTION

This invention relates to the coupling of a two conductor transmission line to a conventional antenna designed for operation over a frequency range which is a significant portion of the nominal operating frequency thereof and more particularly to an improved coupling method and means for enabling an impedance match to be obtained between the transmission line and antenna at any operating frequency throughout the range of frequencies for which the antenna is designed.

BACKGROUND OF THE INVENTION

Due to practical considerations including safety and efficiency, an antenna is almost always located at a remote location with respect to the transmitter or receiver associated therewith. Thus, in conventional antenna systems, a transmission line of the two conductor type such as a coaxial cable or a twin lead line of substantial length must be used to connect the antenna to the transmitter or receiver.

For optimum performance, the impedance of an antenna must be matched to the impedance of the transmission line and any mismatch in impedance therebetween will increase the standing wave present on the transmission line when transmitting or reduce the signal present on the transmission line when receiving. Such impedance matching must occur physically at the point of interconnection between the transmission line and the antenna and thus at a location remote from the transmitter or receiver.

In the prior art, various devices such as baluns or transformers have been provided at the point of interconnection between the transmission line and the antenna to improve the impedance match therebetween. Such devices have either been highly frequency sensitive or have simply produced a somewhat degraded impedance match over a broader range of frequencies. Attempts to provide an adjustable impedance matching device to enable optimum matching over a range of frequencies have not been satisfactory at least in conventional antenna systems because of the remote physical location at which such a device must be placed.

Conventional antenna systems, to which this invention is applicable, are designed for operation over a range of frequencies which is a significant portion of the nominal operating frequency thereof and include a wide variety of configurations ranging from simple whips and halfwave dipoles through complicated quad antennas and parasitic arrays. This invention is not directly applicable to helical antenna designs and parabolic reflectors which are generally designed for operation over a frequency range which is an insignificant portion of their nominal operating frequencies and usually employ wave guides for coupling between the antenna and the associated transmitter or receiver.

According to the teaching of this invention, a simple, convenient, inexpensive and reliable method and means is provided whereby an optimum impedance match may be obtained between a two conductor transmission line and a conventional antenna at any frequency throughout the frequency range for which the antenna is designed.

SUMMARY OF THE INVENTION

According to this invention, a two conductor transmission line is coupled to a conventional antenna including a substantially rectilinear antenna element having an effective length of at least one quarter wave length at the middle of the frequency range for which the antenna is designed and a substantially zero impedance point at one end thereof by placing a substantially rectilinear coupling conductor having an effective length of about one quarter wave length at the middle of the frequency range in close spaced co-planar relation to the antenna element and with one end of the coupling conductor adjacent the substantially zero impedance end of the antenna element. The adjacent ends of the antenna element and coupling conductor are electrically connected to each other. One conductor of the transmission line is coupled to the antenna element at the substantially zero impedance end thereof. The other conductor in the transmission line is coupled to the coupling conductor at the end thereof which is connected to the antenna element. The spacing between the coupling conductor and the antenna element along the co-extensive lengths thereof is adjusted to match the impedance of the transmission line to the impedance of the antenna at each selected frequency in the frequency range for which the antenna is designed.

BRIEF DESCRIPTION OF THE DRAWING

This invention will be more fully understood from a reading of the following detailed description thereof in conjunction with the appended drawing wherein.

DETAILED DESCRIPTION OF PREFERRED EMBODIMENTS

Figure 1:
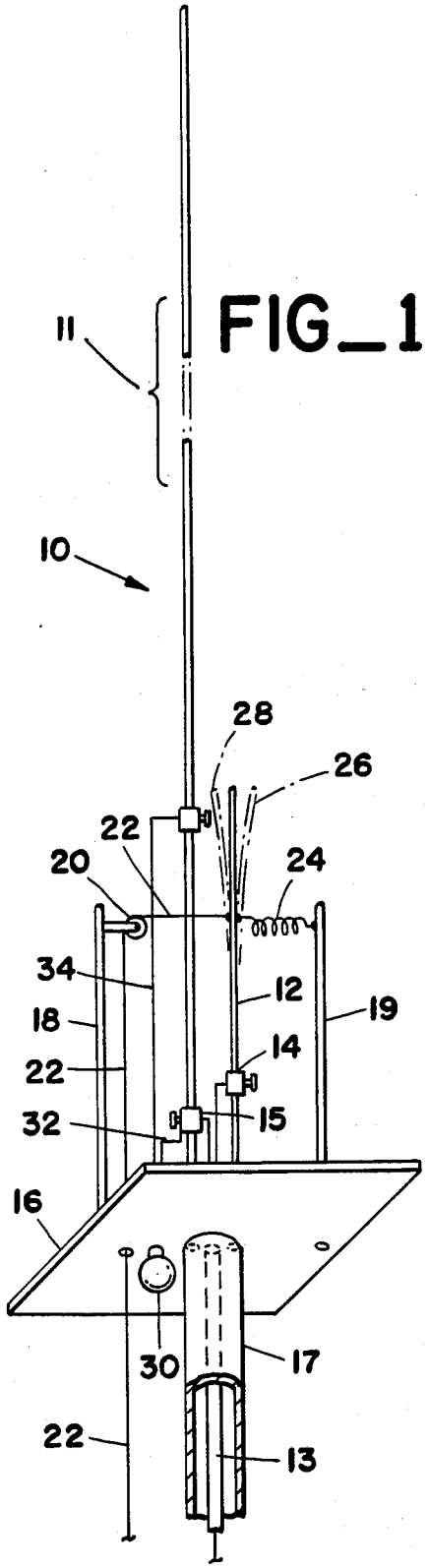
FIG. 1 is a perspective view of an embodiment of this invention including a broad band antenna of the J-configuration designed for operation in the two meter wavelength amateur radio band.

Referring to FIG. 1, an embodiment 10 of this invention including a J-configuration antenna designed for operation in the two meter wavelength amateur radio band is shown in perspective. Thus the radiating element 11 of the antenna comprises a substantially rectilinear conductor about forty-nine inches long which may be made of one-quarter inch diameter steel or aluminum rod or tubing, for example. A substantially rectilinear coupling conductor 12 about sixteen inches long is mounted in parallel relation to the radiating conductor 11 at one end thereof. The coupling conductor 12 may also be made of steel or aluminum rod or tubing, for example, having a diameter of about one-sixteenth of an inch. Thus the radiating conductor 11 has a length which is about three-quarters of a wavelength and the coupling conductor 12 has a length which is about one-quarter wavelength in the two meter amateur radio band. The adjacent ends of the radiating conductor 11 and coupling conductor 12 are galvanically connected to each other as is well known in the prior art.

As is also well known in the prior art, a two wire transmission line shown in FIG. 1 as a coaxial cable 13 is used to couple radio frequency energy to the antenna. As is also well known in the prior art, each of the conductors of the two wire transmission line are coupled to a different one of the radiating conductor 11 and coupling conductor 12 at points spaced from the interconnected adjacent ends thereof in order to provide an optimum impedance match between the two conductor transmission line and the antenna at a selected frequency in the two meter wavelength amateur radio band. See, for example, U.S. Pat. No. 2,124,424, issued to Leeds on July 19, 1938 and U.S. Pat. No. 4,259,673, issued to Guretzky on Mar. 31, 1981.

Thus, in FIG. 1, the center conductor of the coaxial cable 13 is shown electrically connected to the coupling conductor 12 by means of a clamp 14 which may be fixed along the length of the coupling conductor 12. Similarly, the outer conductor or sheath of the coaxial cable 13 is shown connected to the radiating conductor 11 by means of a clamp 15 which may be fixed along the length of the radiating conductor 11. According to the teaching of the prior art, the spacing between the coupling conductor 12 and the radiating element 11 was not believed to be critical so long as it was less than about one-twentieth of a wavelength at the operating frequency. As shown in FIG. 1, such spacing is about one and one-half inches, whereas one-twentieth of a wavelength in the two meter amateur radio band would be about three inches.

It will be understood that for best operation the radiating conductor 11 of the antenna should be mounted at a substantial height above the ground. To this end, the radiating conductor 11 and coupling conductor 12 may be mounted on a metal plate 16 which is in turn mounted on the end of an elongated pipe 17. The adjacent ends of the radiating conductor 11 and coupling conductor 12 may be soldered, brazed or welded into appropriate holes through the major surfaces of the metal plate 16 and project perpendicularly therefrom. The mounting pipe 17 may be fixed to the opposite major surface of the metal plate 16 from the antenna as by brazing or welding. The mounting pipe 17 may, for example, comprise a one and one-half inch steel pipe which may be fixed to a roof, chimney, tower, or alternatively, mounted in the ground with appropriate guy wires and with appropriate length to position the antenna at an elevated location.

From the above it will be understood that it would be difficult to adjust the clamps 14 and 15 after the antenna is in its final operating position. Thus, in the prior art, the position of the clamps 14 and 15 have been adjusted for optimum impedance matching at the desired operating frequency with the antenna essentially at ground level. When the antenna is subsequently elevated to its operating position, deterioration of the impedance match often occurs due to surrounding structures, geographic contours and atmospheric conditions. Furthermore, any deviation from the frequency used to establish the impedance match will result in a deterioration of such match. Thus optimum impedance matching is seldom obtained according to the prior art, and even when it is obtained, such optimum impedance match is highly frequency sensitive.

Applicant has discovered that an optimum impedance match between the two conductor transmission line and the antenna shown in FIG. 1 may be obtained by changing the spacing between the coupling conductor 12 and the radiating conductor 11 along the coextensive lengths thereof. Thus as shown in FIG. 1, a pair of wooden dowels 18, 19 are each mounted at one of their ends in appropriate holes provided through the metal plate 16 with the dowels 18, 19 extending in parallel coplanar relation to each other and to the radiating conductor 11 and coupling conductor 12. A nylon pulley 20 is mounted at the free end of the dowel 18 and a monofilament nylon line 22 attached to the coupling conductor 12 toward the free end thereof is passed about the nylon pulley 20 and extends to the ground. One end of a tension spring 24 is mounted at the free end of the other dowel 19 with the opposite end of the tension spring 24 attached to the coupling conductor 12 toward the free end thereof. The tension spring 24 is preferably selected to resiliently deflect the coupling conductor 12 away from the radiating conductor 11. Thus by pulling on the monofilament nylon line 22, the coupling conductor 12 may be deflected toward the radiating conductor 11 against the tension of the spring 24.

In use, according to the teaching of this invention, the impedance of the antenna would be matched to the impedance of the coaxial cable 13 at the middle of the two meter band with the antenna at ground level and the coupling conductor 12 held in its normal position against the force of the spring 24 as indicated in solid line in FIG. 1. The antenna would then be elevated and mounted in its operating location at which point the tension on the monofilament nylon line 22 would be selected to adjust the deflection of the coupling conductor 12 with respect to the radiating conductor 11.

From the above discussion it will be understood that relieving the tension on the monofilament line 22 will allow the tension spring 24 to pull the coupling conductor 12 away from the radiating conductor 11 as shown by the dotted lines 26 in FIG. 1. In this position, the impedance match between the coaxial line 13 and the antenna will be improved at the upper end of the two meter amateur radio band. Similarly, increasing the tension on the monofilament nylon line 22 will tend to pull the coupling conductor 12 toward the radiating conductor 11 as indicated by the dotted lines 28 in FIG. 1. In this position the impedance match between the coaxial line 13 and the antenna will tend to be optimized at the lower end of the two meter amateur radio band.

The monofilament nylon line 22 may be extended into close proximity to the transmitting or receiving equipment which may include appropriate instruments for measuring the standing wave on the coaxial line 13. Thus the tension on the monofilament nylon line 22 may be adjusted to maintain optimal coupling between the coaxial cable 13 and the antenna corresponding to a minimum standing wave ratio at any operating frequency within the two meter amateur radio band and under all atmospheric and other conditions which might otherwise detract from the optimal coupling to the antenna.

However, it may not always be convenient to extend the monofilament nylon line 22 to the vicinity of the transmitter or receiver. Furthermore, instruments for measuring the standing wave ratio on the coaxial line 13 may be unavailable to the operator due to expense or other considerations. A simple and inexpensive device for monitoring the impedance match between the coaxial cable 13 and the antenna according to this invention is shown in FIG. 1. Such device includes a simple voltage sensitive light source 30 such as a light emitting diode or a high voltage resistive filament type lamp, for example, including a pair of leads 32 and 34 connected to spaced points along the axial length of the radiating conductor 11. Optimum impedance matching between the coaxial line 13 and the antenna will produce a maximum voltage differential between such spaced points. Thus, by adjusting the tension on the monofilament nylon line 22 for maximum brilliance of the light source 30, optimal impedance matching may be obtained. By extending the monofilament nylon line 22 to the base of the mounting pipe 17 or some other point from which the light source 30 may be observed from the ground, optimal coupling of energy to the antenna may be conveniently obtained at any desired frequency in the operating range and under all ambient conditions.

Figure 2:
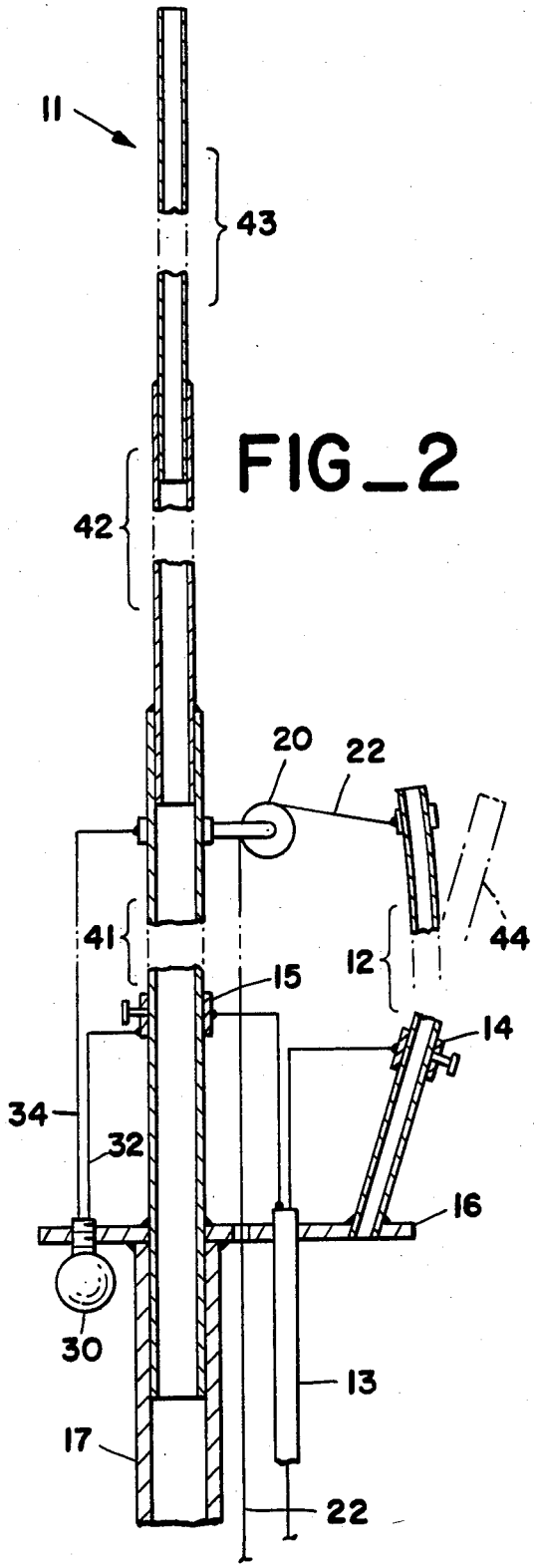
FIG. 2 is a cross-sectional view of another embodiment of this invention including a broad band antenna of the J-configuration designed for operation in the 20 meter wavelength amateur radio band.

Referring to FIG. 2, an embodiment of this invention designed for operation in the twenty meter wavelength amateur radio frequency band is shown in cross-section. For ease of understanding, the reference numerals of FIG. 1 have been used in FIG. 2 to identify corresponding elements of the invention. However, it will be understood that such elements are scaled up in size for operation at the lower frequency.

Thus, the radiating element 11 of the embodiment would be some fifty feet long and may be fabricated by partially telescoping twenty foot lengths of aluminum or steel tubing or pipe of decreasing diameter. Thus, as shown in FIG. 2, one end of a twenty-foot length of one inch diameter pipe 41 receives the end of a twenty foot length of three-quarter inch pipe 42. The other end of the pipe 42 in turn receives one end of a twenty-foot length of five-eighths inch diameter pipe 43. The pipes may be brazed or welded rigidly to each other and the free end of the large pipe 41 may be brazed or welded in the end of a mounting pipe 17 of appropriate diameter and length. The mounting pipe 17 may have an apertured metal plate 16 brazed to the end thereof to support the coupling conductor 12.

The coupling conductor 12 may comprise a sixteen foot length of five eighths inch steel or aluminum tubing. According to this invention, the coupling conductor 12 is mounted to the steel plate 16 in coplanar relation to the radiating conductor 11 but extending away therefrom at an angle, as indicated by the dotted lines 44 in FIG. 2. A sixteen foot length of five-eighths inch tubing will have sufficient resilience to allow it to be deflected toward the radiating conductor 11 by means of a nylon pulley 20 and line 22. As shown in FIG. 2, the nylon pulley 20 is mounted at the upper end of the large diameter pipe 41 of the radiating conductor 11 and the nylon line 22 is attached to the coupling conductor 12 toward the free end thereof. Thus, by applying tension to the nylon line 22, the coupling conductor may be deflected inwardly toward the radiating conductor 11 for impedance matching in accordance with the teaching of this invention.

The spacing between the fixed end of the coupling conductor 12 and the radiating conductor 11 may be about six inches and the mounting angle of the coupling conductor 12 should be sufficient to insure optimal impedance matching at the high end of the twenty meter amateur radio frequency band. As discussed hereinabove, the adjustable clamps 14 and 15 may be adjusted for optimal coupling at the middle of the twenty meter amateur radio frequency band with the coupling conductor 12 deflected inwardly to a central location by applying tension to the nylon line 22. Thus, adjustment of the tension on the nylon line 22 will enable optimum coupling to be obtained at all frequencies in the twenty meter amateur radio frequency band. Optimal coupling may be indicated by means of the light source 30 or by direct observation of a standing wave ratio meter coupled to the coaxial cable 13.

Figure 3:
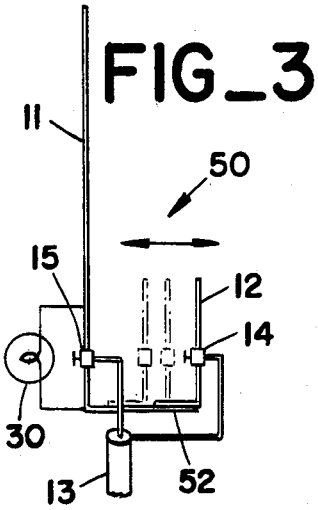
FIG. 3 is a schematic representation of a further embodiment of this invention including a broad band antenna of the J-configuration.
Figure 4:
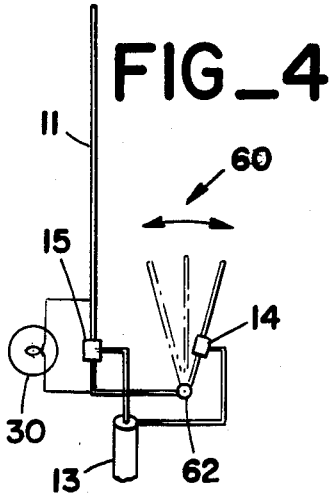
FIG. 4 is a schematic representation of yet another embodiment of this invention including a broad band antenna of the J-configuration.

It will be understood that according to the embodiments 10 and 40 of this invention shown in FIGS. 1 and 2, respectively, the coupling conductor 12 is rigidly mounted at one end and deflected along its length toward and away from the radiating element 11. Referring to FIGS. 3 and 4, embodiments of this invention are shown schematically in which the coupling conductor 12 is moved bodily with respect to the radiating conductor 11. In FIGS. 3 and 4, the reference numerals of FIGS. 1 and 2 have been used to identify corresponding parts for ease of understanding.

According to the embodiment 50 of this invention shown in FIG. 3, the coupling conductor 12 is mounted for bodily sliding movement toward and away from the radiating conductor 11. According to the embodiment 50, the coupling conductor 12 need not be resilient and spring-loading of the sliding mount is not essential. However the embodiment 50 has the disadvantage that a sliding electrical contact means 52 must be present at a low impedance, high current point in the antenna system. Thus, appropriate low resistance sliding electrical contact means 52 would be required, introducing repair and maintenance considerations.

Referring to FIG. 4, an embodiment 60 of this invention is shown in which the coupling conductor 12 is pivoted bodily around one end thereof toward and away from the radiating conductor 11. According to the embodiment 60, a pivoting joint 62 is interposed in the antenna system at a low impedance, high current point. Again, an appropriate electrical contact means would be required and repair and maintenance considerations would arise. Thus, the embodiments 10 and 40 are preferred, according to the teaching of this invention, although embodiments 50 and 60 may have advantages in certain specific situations. For example, spring-loading of the embodiment 60 is not essential and under high vibration conditions, the pivotal position of the coupling conductor 12 with respect to the radiating conductor 11 may be rigidly maintained by an appropriate pivoting mechanism.

Although a coaxial cable 13 has been shown in FIGS. 1 through 4, it is to be understood that the teaching of this invention is equally applicable to the impedance matching of an antenna to two conductor transmission lines of the twin lead type. Furthermore, although a J-configuration antenna is shown in FIGS. 1 through 4, the teaching of this invention is applicable to any antenna design which includes an antenna element having an effective length greater than one-quarter wavelength at all operating frequencies thereof. For example, referring to FIG. 5, an embodiment of this invention in a delta-loop antenna configuration is shown.

The radiating conductor of a delta-loop configuration defines a triangle, each side of which has an effective length of about one-third wavelength in the operating frequency range. Thus, the radiating conductor 72 of a delta-loop antenna may comprise a loop of ten-gauge aluminum or steel wire supported by means of a pair of towers 74. The loop of ten-gauge wire 72 is suspended from the top of the towers 74 by means of lengths of guy wire 75 and insulators 76 at points spaced along the loop from each other by about one-third wavelength in the operating frequency range. The remainder of the loop may be tethered to the ground by means of a guy wire 77 to form the desired triangular shape.

According to the teaching of this invention, a coupling conductor 82 in the form of a ten-gauge aluminum wire having an effective length of about one-quarter wavelength in the operating frequency range is electrically connected at one end to the point of the delta-loop 72 which is tethered to the ground by the guy wire 77. The free end of the coupling conductor 82 is supported at the top of one of the towers 74 by means of a tension spring 84, nylon pulley 85 and monofilament nylon line 86. The nylon pulley 85 is supported from the top of the tower 74 by the tension spring 84 and the monofilament nylon line 86 is received about the pulley 85. The monofilament nylon line 86 is also received through a further pulley 87 spaced downwardly from the top of the tower 74. Thus, the tensioning of the monofilament nylon line 86 will cause the coupling conductor 82 to pivot about the end thereof which is attached to the delta-loop antenna 72 thereby producing a variation in the spacing between the coupling conductor 82 and one side of the triangular loop 72 along the coextensive lengths thereof.

A two conductor transmission line in the form of a twin lead transmission line 88 may be used to drive the delta-loop 72. One of the twin leads of the transmission line 88 is coupled to the coupling conductor 82 and the other of the twin wires is coupled to the adjacent side of the delta-loop antenna 72. The spacing of such couplings from the point of interconnection between the coupling conductor 82 and the delta-loop antenna 72 may be adjusted to provide an optimal impedance match at the middle of the operating frequency range of the delta-loop antenna 72 with the coupling conductor 82 centrally positioned in its range of movement. The tension on the monofilament line 86 may then be varied to provide optimal impedance matching between the twin lead transmission line 88 and the delta-loop antenna 72 at each specific frequency within the operating frequency range of the delta-loop antenna 72. Again, a standing wave ratio meter attached to the twin lead transmission line 88 may be employed to monitor the impedance match or other visual indicating means may be used.

Figure 6:
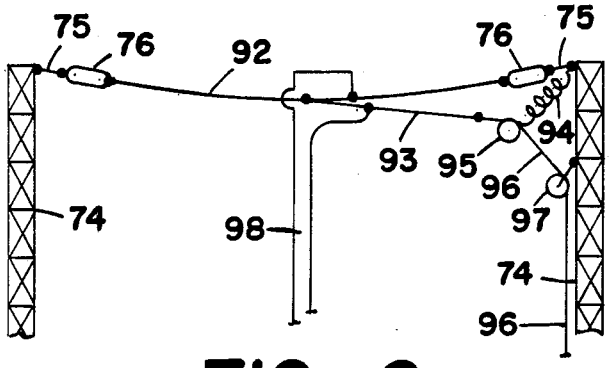
FIG. 6 is a fragmentary view in elevation of an embodiment of this invention including a half wave dipole type broad band antenna.

Referring to FIG. 6, an embodiment of this invention in a half-wave dipole configuration is shown. According to this embodiment of the invention, a radiating conductor 92 in the form of a length of ten-gauge aluminum or steel wire is suspended between the tops of a pair of towers 74 by lengths of guy wire 75 and insulators 76 at opposite ends thereof. The radiating conductor 92 has an effective length of about one-half wavelength in the desired operating frequency range. A coupling conductor 93 of ten-gauge aluminum or steel wire is provided having one of its ends electrically connected to the radiating conductor 92 substantially at the middle thereof. The free end of the coupling conductor 93 is supported on the top of one of the towers 74 by means of a tension spring 94, nylon pulley 95 and monofilament nylon line 96. The nylon pulley 95 is supported on the tower 74 by means of the tension spring 94. The monofilament nylon line 96 is attached to the free end of the coupling conductor 93 and received about the pulley 95. A twin lead transmission line 98 is used to drive the antenna. One of the twin leads of the transmission line 98 is attached to the coupling conductor 93 and the other of the twin leads of the transmission line 98 is connected to the portion of the radiating conductor 92 which is adjacent the coupling conductor 93.

As described hereinabove, the coupling of the leads of the transmission line 98 to the coupling conductor 93 and radiating conductor 92 are spaced from the interconnection thereof to provide an optimal impedance match at the middle of the operating frequency range with the coupling conductor 93 in a central location. The monofilament nylon line 96 may then be tensioned to cause the coupling conductor 93 to pivot around the point of its interconnection to the radiating conductor 92 thereby varying the spacing between the coupling conductor 93 and the adjacent portion of the radiating conductor 92 in order to obtain an optimal impedance match at each frequency within the operating frequency range of the antenna.

Figure 5:
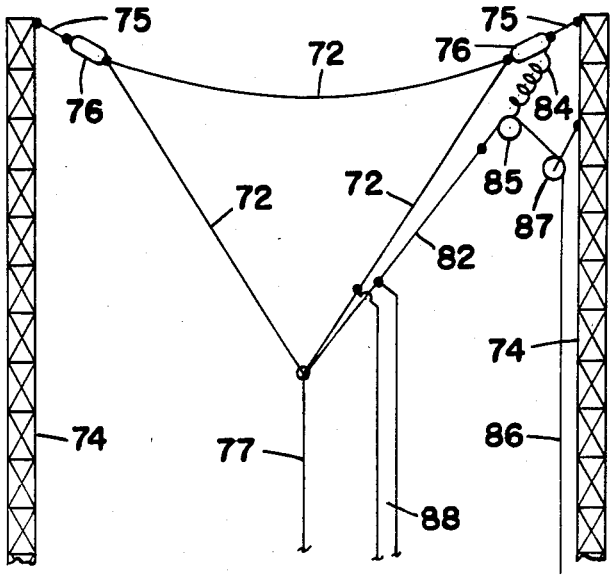
FIG. 5 is a fragmentary view in elevation of an embodiment of this invention including a "delta" type broad band antenna.

It will be understood that the delta loop antenna of FIG. 5 and the half-wave dipole antenna of FIG. 6 may be modified to include parasitic arrays of antenna elements as desired. In addition, other antenna configurations having an element with an effective length of at least one-quarter wavelength in the operating frequency for which it is designed can embody the teaching of this invention as described hereinabove.

Figure 7:
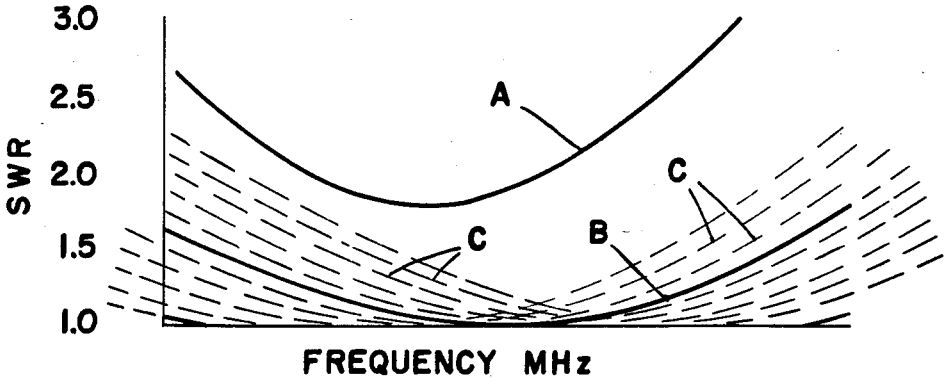
FIG. 7 is a graph illustrating the effect of this invention in terms of the standing wave present on the two conductor transmission line in a transmitting system embodying this invention.

Referring to FIG. 7, a graph is shown to illustrate the effect of applicant's invention. Thus the operating frequency of an antenna is plotted along the ordinate of the graph and the standing wave ratio on a transmission line connected to the antenna is plotted along the abscissa of the graph. The solid line A on the graph illustrates the standing wave ratio which may be present on a two-conductor transmission line connected to an antenna without the use of applicant's invention and without adjusting the coupling points to achieve an impedance match at any frequency. The solid line B on the graph illustrates the standing wave ratio present on a two-conductor transmission line where the coupling points of the two conductors have been adjusted for optimal impedance match at a given frequency toward the middle of the operating frequency range according to the teaching of the prior art. The dotted lines C on the graph illustrates the effect of adjusting the spacing between a coupling conductor and an adjacent antenna element along their coextensive lengths according to the teaching of this invention. Each of the dotted lines represent a different adjustment in the spacing between the coupling conductor and the antenna element. It is to be understood that such spacing is infinitely variable thus making it possible to obtain the optimal impedance match providing a one-to-one standing wave ratio on the two conductor transmission line at any frequency within the operating range of the antenna.

It is believed that those skilled in the art will make obvious structural modifications in the embodiments of this invention as shown in the drawing and described hereinabove without departing from the scope of the following claims. For example, it is not necessary that a nylon pulley or monofilament nylon line be used. It is only necessary that the coupling conductor be insulated from the mechanism used to adjust its position and that such mechanism not introduce aberrations in the radiation pattern of the antenna.

What is claimed is:

1. The method of coupling a two conductor transmission line to a "J"-antenna designed for operation in a given frequency range, said "J"-antenna comprising a substantially rectilinear conductive antenna element having an effective length of at least one quarter wave length at the middle of said given frequency range and a substantially zero impedance point at one end thereof, and of making an optimum inpedance match between the transmission line and the "J"-antenna, comprising the steps of:

(a) placing a substantially rectilinear coupling conductor having an effective length of about one quarter wave length at the middle of such given frequency range in close spaced co-planar relation to said antenna element with one end of said coupling conductor adjacent said one end of said antenna element;

(b) galvanically connecting said one end of said coupling conductor to said one end of said antenna element;

(c) electrically coupling one conductor of said two conductor transmission line to said antenna element in spaced relation to said one end thereof;

(d) electrically coupling the other conductor of said two conductor transmission line to said coupling conductor in spaced relation to said one end thereof; and (e) selectively adjusting the spacing between said coupling conductor and said antenna element along the coextensive lengths thereof to cause the impedance of said antenna to approach the impedance of said transmission line at a selected frequency in said given frequency range, using a mechanical coupling means extending from the "J"-antenna to a remote location where an operator can make the adjustment while monitoring the impedance match from the remote location to optimize the match.

2. The method of claim 1 including the step of mechanically mounting said one end of said coupling conductor to said one end of said antenna element for sliding relative movement therebetween with said coextensive lengths thereof substantially parallel in said co-planar relation.

3. The method of claim 1 including the step of mechanically mounting said one end of said coupling conductor to said one end of said antenna element for pivotal relative movement therebetween with said coextensive lengths thereof in said co-planar relation.

4. The method of claim 2 or claim 3 including the step of resiliently biasing said relative movement between said coextensive lengths of said coupling conductor and said antenna element toward a given relative position.

5. The method of claim 1 including the steps of making said coupling conductor of resilient material and rigidly mounting said one end of said coupling conductor with respect to said one end of said antenna element whereby said spacing therebetween may be selectively adjusted by elastic deflection of said coupling conductor along the length thereof.

6. The method of claim 1, wherein the mechanical coupling means comprises a flexible tension line arranged to pull the coupling conductor toward the conductive antenna element, and including resilient biasing means for biasing the coupling conductor away from the antenna element.

7. Means for coupling a two conductor transmission line to a "J"-antenna designed for operation in a given frequency range, said antenna comprising a substantially rectilinear conductive antenna element having an effective length of at least one quarter wave length at the middle of said given frequency range and a substantially zero impedance point at one end thereof, and for making an optimum impedance match between the transmission line and the "J"-antenna, comprising:

(a) means mounting a substantially rectilinear coupling conductor have an effective length of about one quarter wave length in the middle of said given frequency range in close spaced co-planar relation to said antenna element with one end of said coupling conductor adjacent said one end of said antenna element;

(b) means galvanically connecting said one end of said coupling conductor to said one end of said antenna element;

(c) means electrically coupling one conductor of said transmission line to said antenna element in spaced relation to said one end thereof;

(d) means electrically coupling the other conductor of said transmission line to said coupling conductor in spaced relation to said one end thereof; and (e) means for selectively adjusting the spacing between said coupling conductor and said antenna element along the coextensive length thereof from a remote location whereby the impedance of said transmission line may be caused to approach the impedance of said antenna at a selected frequency in said given frequency range, including mechanical coupling means extending from the "J"-antenna to the remote location where an operator can make the adjustment whie monitoring the impedance match from the remote location to optimize the match.

8. Means as claimed in claim 7 including mechanical means mounting said one end of said coupling conductor to said one end of said antenna element for sliding relative movement therebetween with said coextensive lengths thereof substantially parallel in said co-planar relation.

9. Means as claimed in claim 7 including mechanical means mounting said one end of said coupling conductor to said one end of said antenna element for pivotal relative movement therebetween with said coextensive lengths thereof in said co-planar relation.

10. Means as claimed in claim 8 or claim 9 including resilient means biasing said relative movement between said coextensive lengths of said coupling conductor and said antenna element toward a given relative position.

11. Means as claimed in claim 7 wherein said coupling conductor is made of resilient material with one end thereof rigidly mounted with respect to said antenna element whereby said spacing therebetween may be selectively adjusted by elastic deflection of said coupling conductor along the length thereof.

12. The apparatus of claim 7, wherein the mechanical coupling means comprises flexible tension line arranged to pull the coupling conductor toward the conductive antenna element, and including resilient biasing means for biasing the coupling conductor away from the antenna element.

* * * * *